US005491404A

United States Patent [19]

Settles et al.

[11] Patent Number: 5,491,404

[45] Date of Patent: Feb. 13, 1996

[54] CURRENT SENSE WITH VIRTUAL GROUND

[75] Inventors: Steven R. Settles, Sterling Hts., Mich.; Fady Tawil, Roseville, Minn.

[73] Assignee: United Technologies Automotive, Inc., Dearborn, Mich.

[21] Appl. No.: 193,313

[22] Filed: Feb. 8, 1994

[51] Int. Cl.[6] ..... G05F 1/12

[52] U.S. Cl. ..... 323/283; 323/266; 330/69

[58] Field of Search ..... 323/282, 283, 323/351, 266; 330/69, 146, 260, 261

[56] References Cited

U.S. PATENT DOCUMENTS 4,085,379 4/1978 Kubach et al. ..... 330/69

4,575,673 3/1986 Tedeschi et al. ..... 323/351

5,254,937 10/1993 Mizoguchi ..... 323/283

*Primary Examiner*—Peter S. Wong

*Assistant Examiner*—Y. Jessica Han

[57] ABSTRACT

A method and apparatus for reducing the effects of ground float upon electrical signal measurements in an electronic control system. The signals are measured with respect to a virtual ground rather than signal or chassis ground, where the virtual ground provides a regular and reliable signal level regardless of circuit electrical variances.

19 Claims, 5 Drawing Sheets

CURRENT SENSE WITH VIRTUAL GROUND

BACKGROUND OF THE INVENTION

1. Technical Field

This invention relates generally to a method and apparatus for reducing the effects of ground float in an electronic control circuit, and more particularly to a method and apparatus for ensuring accurate readings in a vehicle electronic controller.

2. Discussion of the Related Art

Precise management and control of operating parameters have allowed electronic controller to greater improve the operating performance of the systems they control. Consequently, electronic controllers are used extensively in modern-day vehicles. Some are specialized controllers that control a single system and some are general controllers that control a variety of general functions. For example, there are engine controllers that monitor fuel, air and spark behavior to optimize fuel economy and maximize engine performance, and body controllers that monitor vehicle functions, such as wheel and vehicle speed, and which control a variety of vehicle functions such as active suspension and illuminating warning lights.

While controllers have allowed greater control of vehicle performance, they can only achieve optimal control by precisely monitoring and controlling parameters. However, one persistent and difficult problem associated with precisely measuring parameters for use by a vehicle electronic controller is the fact that any measurement, by its nature, is an imprecise, relative measurement. That is, the act of measuring involves gauging a parameter against a reference or criteria. In vehicle controllers, the reference point usually used in measurements is ground. Ground is commonly assumed to equal a "zero" level, so that the measurement of signals involves determining their relative magnitude over ground. Unfortunately, in vehicles, ground does not always remain at zero. Depending upon the characteristics of the vehicle electrical system, ground can varying dynamically by several volts during the operation of the controller. This phenomenon is commonly referred to as "ground float", because the absolute level of the ground varies, or floats. Therefore, a signal measured as having a magnitude of "X" is really a signal having a true magnitude of "X over ground". If ground varies, it is obvious that the true magnitude of the signal may be clouded by the fact that it is measured relative to a floating ground.

Several ways to reduce the effects of ground float have proved helpful but not wholly effective. One way of reducing the effect of ground float on an electronic signal measurement is to make the measurement less sensitive. By measuring using a coarser measurement criteria, the variations in ground do not affect the final measurement as much. However, using a coarser scale also reduces the ability of the controller to finely control based upon measured parameters. Another way of reducing ground float is to electrically isolate ground. This often involves complex isolation circuits which attempt to protect ground from being influenced by electrical system variations. Unfortunately, isolation circuits can be expensive and still do not completely protect ground from being affected by circuit variations.

SUMMARY OF THE INVENTION

It is therefore an object of the present invention to provide a method and apparatus for reducing the effect of ground float on electrical signal measurements. The signals are measured with respect to a virtual ground rather than signal or chassis ground, where the virtual ground provides a regular and reliable signal level regardless of circuit electrical variances. One advantage of the present invention is that signal measurements can be relied upon as being true with respect to a true reference, increasing the integrity of the measurement. Another advantage is that, with increased integrity, the measurement can be made using a much finer scale, allowing a finer degree of control. Another advantage is that the virtual ground circuit is built using relatively inexpensive components.

BRIEF DESCRIPTION OF THE DRAWINGS

Other objects, features and advantages of the present invention can be better understood by referencing the following discussion of the presently preferred embodiment in conjunction with the drawings in which.

DESCRIPTION OF THE PRESENTLY PREFERRED EMBODIMENT

Figure 1:
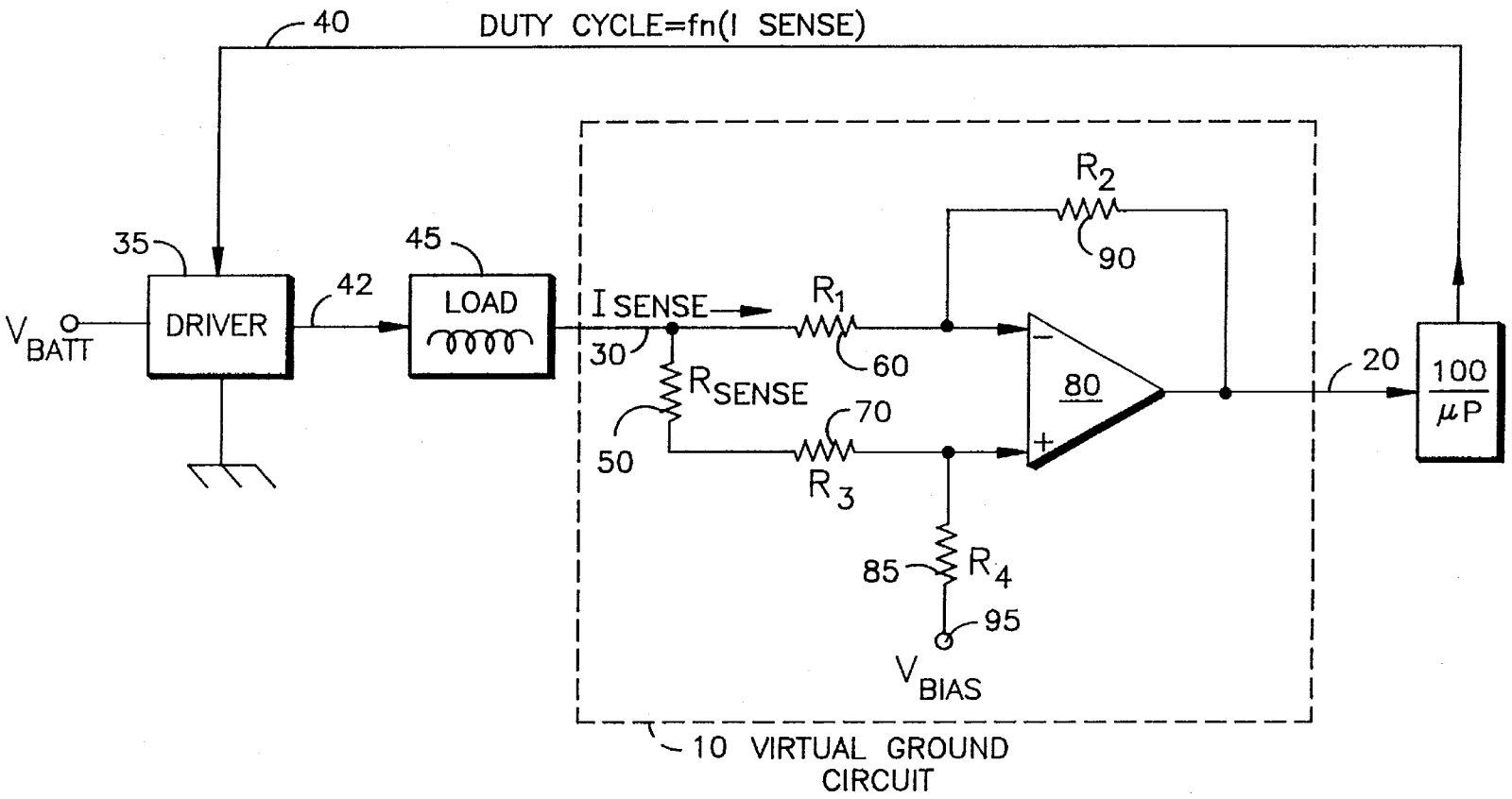
FIG. 1 is a block diagram illustrating the virtual ground circuit of the present invention.
Figure 2:
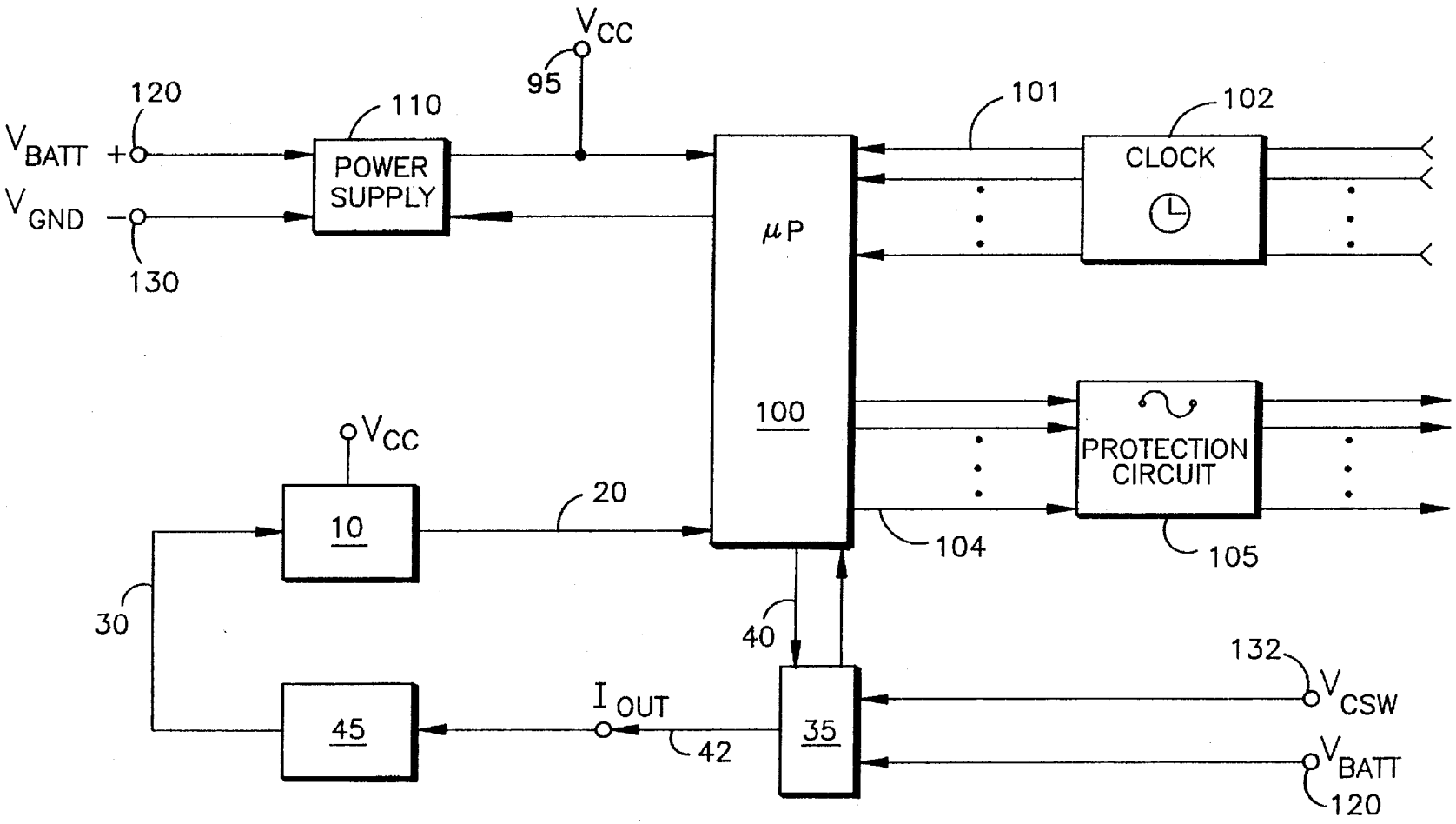
FIG. 2 is a block diagram illustrating a control circuit employing the virtual ground circuit of the present invention.

As shown in both FIGS. 1 and 2, the heart of the invention lies in the virtual ground circuit 10, which provides an output voltage signal 20 proportional to the magnitude of the current input 30 from the power source 35 being measured. Here, the power being measured is generated by a high side smart driver 35 whose the duty cycle 40 is dynamically adjusted to precisely control output current. The current generated 42 by the high side smart power driver 35 powers an electrical load 45. The measured current 30 is actually the current drawn by the electrical load 45. Here, the electrical load requires precise current control to function optimally. Thus, it is important to have a very precise measurement of current draw 30 in order to be able to ensure that the smart driver 35 output current 42 is within its required range.

Referring specifically to the block diagram in FIG. 1, the high side smart power driver 35 is configured for use in driving an inductive load 45, which in this case is a solenoid used to modulate power steering assist fluid pressure in a vehicle assisted power steering system. The current 42 produced by the high side smart power driver 35 drives the solenoid 45, and a measurement of the current draw 30 is determined by measuring the voltage drop across the sense resistor 50 ($R_{SENSE}$). The sense voltage is then processed through the unique virtual ground based feedback loop comprising input conditioning resistors $R_1$ 60 and $R_3$ 70, an op-amp 80, bias resistor $R_4$ 85 and feedback resistor $R_2$ 90. Here, instead of being biased to ground, the bias resistor 85 is biased to a known, precisely controllable bias voltage ($V_{BIAS}$) 95. Because the bias voltage 95 is known and precisely controlled, it does not vary as ground normal does. The measured sense voltage across $R_{SENSE}$ 50 is fed back through the negative feedback loop going from the output 20 of the op-amp 80 through the feedback resistor 90 to the negative input of the op-amp. This means that as driver current 42 increased, the current draw 30 by the solenoid 45 increases and the voltage drop across the sense resistor 50 also increases. This increasing voltage is offset by the bias voltage 95, so that a minimum current level results in an output reading 20 of $V_{BIAS}$ and a maximum current level results in an output reading 20 of a minimum voltage level. Thus, the virtual ground current sense circuit output 20 is directly inversely proportional to the current draw 30.

Here, it is important to note that, because $V_{BIAS}$ 95 is known and precisely controlled, measuring with respect to $V_{BIAS}$ produces a measured value whose true magnitude can be reliably determined. Thus, one key feature lies in the ability to precisely control and, essentially, fix $V_{BIAS}$ 95. If such precise control were achieved using additional, complex circuitry, the benefits of being able to precisely and reliably measure current draw 42 would have to be seriously traded against the costs of the circuitry required to achieve such precise control. Fortunately, one key feature of the present invention is that $V_{BIAS}$ 95 is obtained by utilizing an existing output voltage from the electronic controller's power supply. This circuitry, as will be described in greater detail next, utilizes existing circuitry in conjunction with the virtual ground circuit in a unique and unconventional manner to achieve current signal measurement accuracy previously unobtainable using conventional measurement means.

As shown in FIG. 2, the virtual ground circuit 10 is employed in a generic equipment module (GEM) controller, which controls the specialized function of optimizing power steering assist as a function of vehicle speed, as well as general functions such as the illumination of warning lights, the operation of headlight, tail lights and turn signals, the operation of the windshield wipers and washers, and the operation of the rear window defogger, among other functions. The various signal inputs 101, other than vehicle assisted power steering current, are fed to the microcomputer 100 using an inventive input clocking circuit 102. This circuit 102 is described in detail in U.S. patent application Ser. No. 07/967,484, filed on Oct. 26, 1992, and assigned to the assignee of the present invention, the disclosure of which is hereby incorporated by reference. Furthermore, the output signals 104 from the microcomputer are output protected using an inventive output protection circuit 105. This circuit 105 is described in detail in U.S. patent application Ser. No. 07/967,465, also filed Oct. 26, 1992, and assigned to the assignee of this invention, the disclosure of which is also hereby incorporated by reference. The detailing of the operation of the input clocking 102 and output protection 105 circuits are not critical to the understanding of the invention described in this application, and will therefore not be further discussed. Furthermore, it should be understood that the circuitry and control features described here are for the purposes of illustrating a preferred method of exploiting the invention, but should not be construed as being the only manner in which this invention can be exploited.

The "brains" of the GEM controller is a commercially available Motorola MC68HC05 series microcomputer 100, a 52-pin chip having eight eight-bit A/D input/output lines 101, and three sets of eight-bit output ports 104. Readings are measured at the A/D inputs 101 and control signals are sent out via the outputs 104. The internal operation of the microcomputer 100 provides for the converting of a single analog input into an eight-bit digital value, and is well understood within the art. Likewise, the internal operation of the microcomputer 100 outputs digital values to the eight-bit output ports. Power is provided to the microcomputer 100, as well as other circuits within the controller, via the power supply circuit 110. The power supply takes the vehicle power 120, commonly referred to as $V_{BATT}$ and which is usually between 9 and 18 volts, and vehicle power ground 130, also referred to as battery ground ($V_{GND}$), and regulates the power signal to provide a regular and reliable source of power 95 for the microcomputer 100. This regular and reliable source of power 95 is commonly referred to as $V_{CC}$, and is used not only to power the microcomputer 100 but to bias the virtual ground circuit 10 as well. The microcomputer 100 controls the duty cycle of one of its output lines 40 to regulate the current delivered by the high side smart power driver 35. Specifically, the duty cycle control line 40 is switched on and off via the microcomputer 100 in a controlled manner to vary the duty cycle being driven to the high side driver 35. The high side driver 35, in turn, is power biased by $V_{BATT}$ 120 and pull-up voltage signal $V_{CSW}$ 132, and its output is modulated by the duty cycle switching signal 40. The output 42 from the high side smart power driver 35 powers the inductive load 45, which in this case is the power steering assist fluid control solenoid 45. Because the current draw 30 of the solenoid 45 must be monitored precisely to ensure proper operation of the power assisted steering system, that current 30 is measured by the virtual ground circuit 10. The magnitude of the current 30, as measured by the virtual ground circuit 10, is fed back to the microprocessor 100, which, in turn, modifies the clocking of the duty cycle signal 40 as needed to ensure the current from the high side driver 35 is as desired. Here, the solenoid current draw is normally on the order of a few amps to as low as less than one-half amp. At such low current levels, the sense voltage is generally rather low compared to $V_{CC}$, so that the output from the virtual ground circuit is generally a voltage reading of some significance. This is desirable, since the microcomputer can better read and convert a higher voltage reading than a lower voltage reading.

Figure 3:
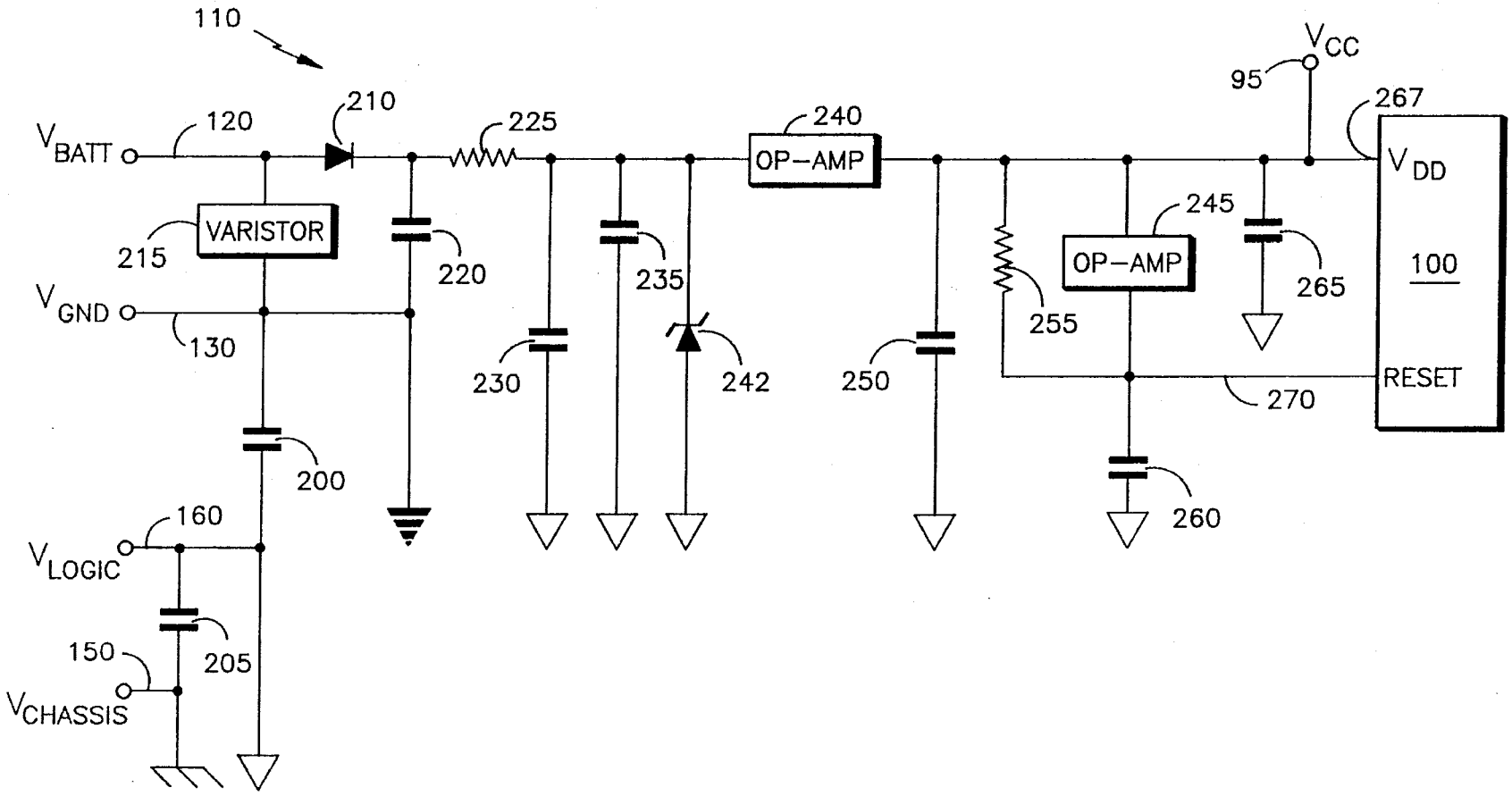
FIG. 3 is a detailed circuit diagram of the power supply circuit employed in the present invention.
Figure 4:
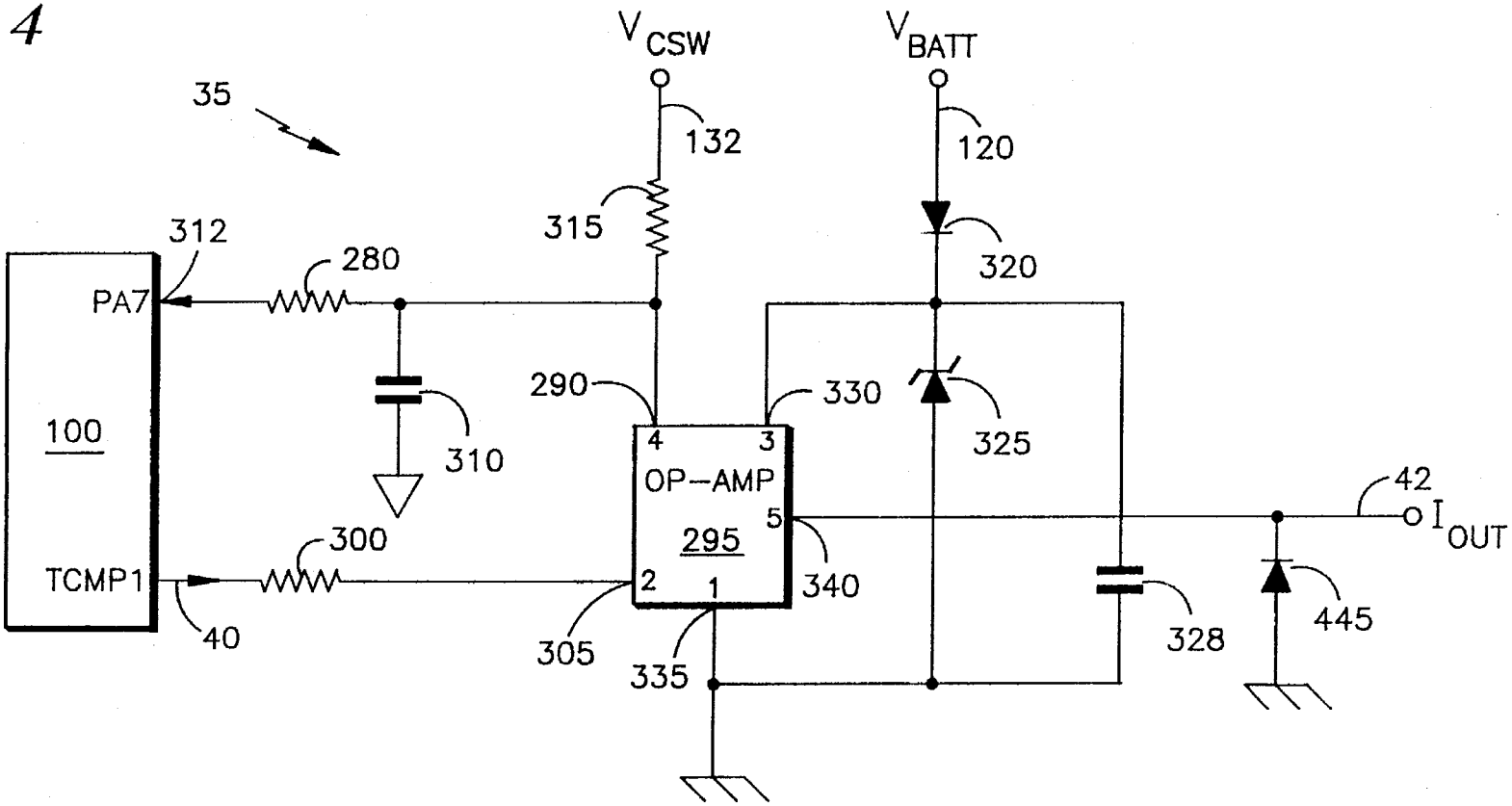
FIG. 4 is a detailed circuit diagram of the high side smart power driver circuit employed in the present invention.
Figure 5:
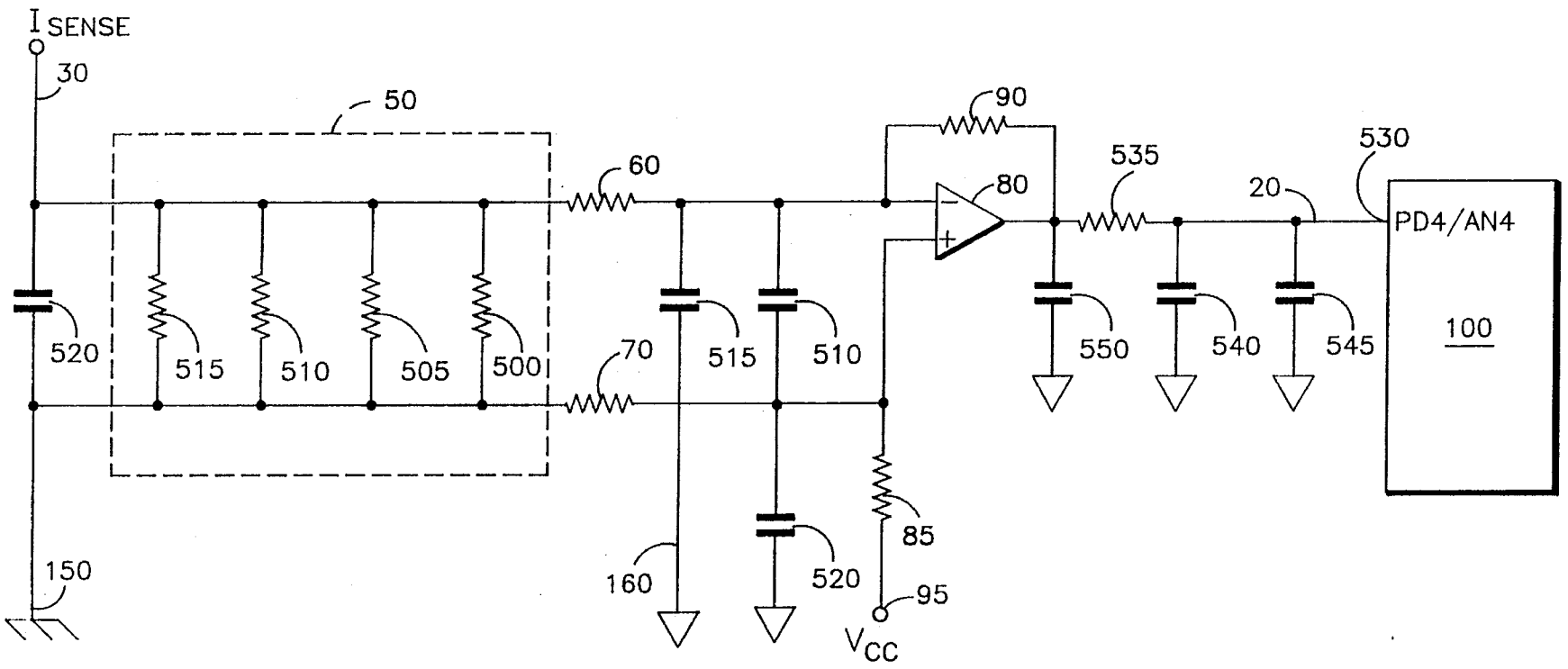
FIG. 5 is a detailed circuit diagram of the virtual ground circuit of the present invention.

To better understand the details of the circuitry just described, FIGS. 3 through 5 provide detailed circuit diagrams of the various major circuit elements. As shown in FIG. 3, the power supply 110 includes an optional RFI/EMI isolation capacitor 200 between battery ground 130 and logic ground 160, and another optional RFI/EMI isolation capacitor 205 between chassis ground 150 and signal ground 160. Diode 210 protects against reverse current, while varistor 215 and 0.01 μF capacitor 220 smooth out the signal. 100 Ω resistor 225, 47 μF capacitor 230 and 0.01 μF capacitor 235 condition the power signal prior to it reaching the regulation portion of the power supply. Here, op-amps 240 and 245 are tied so that the power signal 1 20 goes to the input of op-amp 240 and 220 μF capacitor 250 isolates the output signal from the op-amp. Zener diode 242 protects against reverse current at the input. The output of op-amp 240 is tied to the feedback loop of op-amp 245 via 10 KΩ resistor 255, while 0.01 μF capacitors 260 and 265 isolate the output. The output of the power supply circuit 110 is $V_{CC}$ 95, which is generally 5 volts. The power supply output 95 ($V_{CC}$) is connected to the $V_{DD}$ pin 267 of the microcomputer 100. The microcomputer has a RESET line 270, which drives low to reset the power supply 110 and the microcomputer 100 when required. One of ordinary skill in the art can appreciate that other power supply circuits could be employed, so long as a reliable $V_{CC}$ is produced by the power supply to allow reliable operation of the microcomputer. Here, $V_{BATT}$ is reduced from a DC voltage which can fluctuate, typically, between 9 and 18 volts to a constant $V_{CC}$ of 5 volts.

The power supply 110 provides a constant and reliable source of power 95 to the microcomputer 100. This stands in sharp contrast to battery ground 130, chassis ground 150 and signal ground 160, all of which can vary significantly due to the operation of the electrical system and the influences outside power sources have upon the circuit. For example, battery charge state, circuit load activity and induced electrical fields all affect the true signal level of ground. Induced fields are generated by the vehicle passing through electrical fields, such as generated by power lines and radio transmitters, and are also generated by the vehicle passing through magnetic fields, such as when passing under a metal bridge trestle or over train tracks. Even if the control logic or the circuit isolation could be made sophisticated enough to offset the variations in ground caused by battery charge state and circuit load activity, it is essentially impossible to control the influences induced by the external electromagnetic sources due to their unpredictable nature. Therefore, any measurements taken at the A/D inputs of the microcomputer 100 must be able to compensate for the inherent ground float in the circuit.

As shown in FIG. 4, the high side smart power driver 35 is powered via by $V_{BATT}$ 120 from the vehicle power system and by the clocked duty cycle control signal 40 from the microcomputer 100. The duty cycle control signal 40 is generated at pin TCMP1 of the microcomputer 100. A 10 KΩ resistor 280 is tied between the pin 4 290 of the high side driver op-amp 295 and the PA7 pin of the microcomputer 100. The high side driver op-amp is a VN02N chip, commercially available from a variety of sources. The high side driver op-amp 295 has internal logic circuitry to not only vary its output current as a function of the clocked duty cycle signal 40, but also has internal logic circuitry to provide failure mode information back to the clock driving means. Here, a 2.2 KΩ resistor 300 is tied between the clocked input pin 2 305 of the op-amp 295 and the clocked duty cycle output TCMP1 pin of the microcomputer 100, and there is a 0.01 μF clamping capacitor 310 at the fault output reporting pin 4 290 of the high side driver op-amp 295. If the smart power driver 35 were in fault mode such as when experiencing an overtemperature condition, that fault information is fed to the microcomputer 100 via pin 4 290 of the op-amp 295 to the PA7 pin 312 of the microcomputer. Pull-up voltage signal ($V_{CSW}$) 132 is conditioned by a 1.0 KΩ resistor 315. The pull-up voltage signal ($V_{CSW}$) 132 is a switched 5 volt signal. As is well understood by those of ordinary skill, power consumption while the controller is not active can be reduced by relying upon pull-up voltages to maintain quiescent power to devices (such as the microcomputer and high side driver) while those devices are inactive. On the "high" side of the high side driver op-amp, reverse voltage from $V_{BATT}$ 120 is blocked by diode 320, while zener diode 325 and 0.01 μF capacitor 328 are tied between the pin 3 330 and the pin 1 335 of the op-amp 295. The current output signal 42 comes from the pin 5 340 of the op-amp 295, and is prevented from delivering reverse current by diode 445. The current output 42 of the high side smart power driver circuit 35 varies as a function of the duty cycle of the switching signal from pin TCMP1.

Measurements of the current output signal are taken with respect to the virtual ground bias voltage signal created by the virtual ground circuit 10. As shown in FIG. 5, the virtual ground circuit includes some standard measurement circuit elements, such as a sense resistor network 50, as well as some unique circuit elements. The sense resistor network includes four 1 Ω resistors 500, 505, 510 and 515. The voltage across the sense resistor network 50 is measured against the virtual ground for processing by the microcomputer 100. The sense resistor network 50 is biased between the measured signal ($I_{SENSE}$) 30 and chassis ground 150, with optional RFI/EMI capacitor 520 clamping any unusual voltage variations. The sense voltage reading 20 is determined by measuring the sense voltage, as measured across the sense resistor network 50. There is a 100 pF filtering capacitor 510 shunted across the sense resistor network 50, and optional RFI/EMI clamping capacitors 515 and 520 are tied to either leg of the sense resistor network. The sense voltage is biased not by chassis ground 150 or logic ground 160 but rather by the virtual ground bias voltage signal, which in this case is $V_{CC}$ 95 biased by the 51.1 KΩ bias resistor 85. The sense voltage reading, as biased by the virtual ground voltage signal, is fed into the op-amp 80, which has a 51.1 KΩ feedback resistor 90 creating the negative feedback loop described earlier in conjunction with FIG. 1. Thus, as was earlier discussed, the negative feedback loop results in the output 20 of the virtual ground circuit 10 being between $V_{CC}$ 95 when the measured current is at a minimum and $V_{MIN}$ when the measured current is at a maximum. One of ordinary skill in the art can appreciate that $V_{MIN}$ is typically zero, but can be any other voltage value less than $V_{CC}$. Recalling the earlier discussion in conjunction with FIG. 1, the solenoid acts as the inductive load 45 in this circuit. To condition the output signal 20 properly before it reaches the PD4/AN4 pin 530 of the microcomputer 100, a 51 KΩ resistor 535 and a pair of 0.1 Ω capacitors 540, 545 are tied between the output 20 and the microcomputer 100 input pin 530. An optional RFI/EMI clamping capacitor 550 can also be included.

In operation, the measured current voltage signal 20 from the virtual ground circuit 10 is read by the microcomputer 100 and compared to a set point current measurement determined by the algorithm logic of the microcomputer. In this system, the current draw by the solenoid is precisely controlled to achieve variable power steering assist control. At lower vehicle speeds, more power steering assist is required to steer the vehicle than at higher speeds. Based upon vehicle speed, the microcomputer queries a look-up table to determine the current set point. This set point current is compared with the measured current, and driving current, which is an average between the measured and set point current, is obtained. That average driving current in turn is converted into an equivalent driving duty cycle, and the duty cycle of the TCMP1 pin is adjusted to deliver the driving duty cycle so that the high side driver will now generated the driving current. Of course, one of ordinary skill can appreciate that a variety of methods for utilizing measured current to control generated current could be employed. The internal control method of the microcomputer is described generally here for the purposes of illustration, and is not critical to the understanding of this invention. What is of importance to the understanding of this invention is the operation of the virtual ground circuit 10.

Here, it is important to note that the virtual ground circuit 10 is superior to a standard ground reference measurement circuit and is also superior to a circuit simply using $V_{CC}$ 95 as the current measurement reference. That is because a standard ground reference circuit is susceptible to ground float, and a simple $V_{CC}$ reference circuit has signals to be measured that may have a voltage level below that of $V_{CC}$ 95, which is typically 5 volts. Therefore, using the virtual ground circuit 10 described herein allows the circuit to take advantage of the stability of $V_{CC}$ 95 without having to rely upon the measured signal exceeding $V_{CC}$ to actually elicit a reading.

Furthermore, because the virtual ground circuit of the present invention produces a measured current signal which has a higher voltage level at lower currents than at higher currents, the virtual ground circuit provides a more accurate measurement reading. This is because A/D measurements are inherently more reliable when at the mid range to higher end of their input range scale than at very low input range levels. If the virtual ground circuit were biased by ground instead of $V_{CC}$, low current levels would result in low voltage readings. Thus, the virtual ground circuit of the present invention allows for more precise measurement of current draw by taking advantage of the inherent A/D accuracy characteristics of the microcomputer.

The foregoing description of the circuitry of the presently preferred embodiment was provided for the purposes of illustration, and should not be construed to limit the invention. One of ordinary skill in the art can appreciate that a variety of modifications not described herein may be effected to the invention without departing from the spirit or scope of this invention.

We claim:

1. A circuit for measuring current draw by a load and for adjusting current delivered to said load, said delivered current being generated by a driver having a variable duty cycle which varies in response to said current draw, said circuit including a power supply for providing a source of DC voltage, said circuit comprising:

a differential device having a negative and a positive input and having a differential output;

a sense resistor network shunted across said negative and positive inputs of said differential device having a sense current;

a bias resistor having a first and second connection point, said first connection point of said bias resistor coupled between said positive input of said differential device and said sense resistor network and said second connection point of said bias resistor coupled with said source of DC voltage to provide a virtual ground for said positive input of said differential device; and a feedback resistor coupled between said differential output and said negative input of said differential device, whereby said measured current draw is represented at said differential output as a signal ranging from a maximum value corresponding with the voltage of said source of DC voltage to a minimum value, the magnitude of said differential output being inversely proportional to the magnitude of said sense current.

2. A circuit as recited in claim 1, further comprising a duty cycle varying means for receiving said differential output, for comparing said received output with a predetermined value, and for varying said driver duty cycle to cause said delivered current to increase or decrease such that said received output corresponds with said predetermined value.

3. A circuit as recited in claim 2, wherein said source of DC voltage provides power to said duty cycle varying means.

4. A circuit as recited in claim 2, wherein said duty cycle varying means comprises a memory for storing said predetermined value.

5. A circuit as recited in claim 1, wherein said load has a load input and a load output, said delivered current being coupled with said load input, and said sense resistor network being coupled with said load output, such that said current draw of said load is measured at said output of said load.

6. A circuit as recited in claim 5, further comprising a duty cycle varying means for receiving said differential output, for comparing said received output with a predetermined value, and for varying said driver duty cycle to cause said delivered current to increase or decrease such that said received output corresponds with said predetermined value.

7. A system for eliminating ground fluctuations applied to a system load, said system having an input current and a power supply, said system comprising:

a differential device for differentiating between a negative and a positive input, and for generating a differential output;

a sense load for generating a sense voltage in response to receiving a portion of the input current, said sense load coupling said positive input with said negative input;

a biasing device for providing a virtual ground for said differential device, said biasing device coupled with said power supply for providing a stabilized source of voltage for the system load, said biasing device being further coupled with said positive input of said differential device; and a feedback loop for feeding back said differential output into said negative input of said differential device, the input current being represented at said differential output as a signal having a maximum value corresponding with said voltage of said stabilized source such that the magnitude of the differential output is inversely proportional with the magnitude of said sense voltage.

8. The system of claim 7, wherein said biasing device comprises a biasing load and means for generating a stabilized source of DC voltage from said power supply.

9. The system of claim 7, wherein said differential device comprises a differential operational amplifier.

10. The system of claim 7, further comprising a first input load coupled with said negative input, said sense load, and said feedback loop.

11. The system of claim 10, further comprising a second input load coupled with said positive input, said sense load, and said biasing device.

12. The system of claim 7, wherein said feedback loop comprises a feedback load for feeding back said differential output into said negative input of said differential device.

13. The system of claim 7, further comprising a driving system for generating a drive current for driving the system load, said driving system comprising a duty cycle and a microcontroller for receiving said differential output, for comparing said received differential output with a predetermined value, and for varying said duty cycle to change said driving current such that said received differential output corresponds with said predetermined value.

14. The system of claim 13, wherein the power source provides power to said microcontroller.

15. The system of claim 13, wherein said microcontroller comprises a memory device for storing said predetermined value.

16. The system of claim 13, wherein the system load comprise a load input and a load output, said load input being fed by said driving current, and said load output being fed into said sense load such that the input current is measured at said load output.

17. A system for eliminating ground fluctuations applied to a current sensitive load, said system having an input current and a power supply, said system comprising:

a differential operational amplifier for differentiating between a negative and a positive input, and for generating a differential output;

a sense load for generating a sense voltage in response to receiving a portion of the input current, said sense load coupling said positive input with said negative input;

a biasing device comprising a biasing load and means for generating a stabilized source of DC voltage from said power supply, said biasing load being coupled with said power supply for providing a stabilized source of DC voltage for the current sensitive load, said biasing load being further coupled with said positive input of said differential device such that said biasing device provides a virtual ground for said differential device;

a first and second input load, said first input load being coupled with said negative input, said sense load, and said feedback loop, and said second input load being coupled with said positive input, said sense load, and said biasing device; and a feedback loop comprising a feedback load for feeding back said differential output into said negative input of said differential device, the input current being represented at said differential output as a signal having a maximum value corresponding with said DC voltage of said stabilized source such that the magnitude of the differential output is inversely proportional with the magnitude of the said sense voltage.

18. The system of claim 17, further comprising a driving system for generating a drive current for driving the current sensitive load, said driving system having a duty cycle and comprising a microcontroller for receiving said differential output, for comparing said received differential output with a value stored in a memory device, and for varying said duty cycle to change said driving current such that said received differential output corresponds with said value.

19. The system of claim 17, wherein the current sensitive load comprise a load input and a load output, said load input being fed by said driving current, and said load output being fed into said sense load such that the input current is measured at said load output.

* * * * *

UNITED STATES PATENT AND TRADEMARK OFFICE

CERTIFICATE OF CORRECTION

PATENT NO. : 5,491,404

DATED : Feb. 13, 1996

INVENTOR(S) : Steven R. Settles
Fady Tawil

It is certified that error appears in the above-indentified patent and that said Letters Patent is hereby corrected as shown below:

In the Abstract: After "variances." at the end of the paragraph, insert --The apparatus includes a smart power driver which generates the delivered current, where the smart power driver has a variable duty cycle. The duty cycle of the power driver is varied as a function of current draw. The current draw of the device being driven by the smart power driver is measured against the virtual ground, and any variation between measured current draw and desired current draw are fed back to a logic circuit controlling the smart power driver so that its duty cycle can be accordingly varied to bring measured current draw into accordance with desired current draw.--

Column 6, line 26: "0.1Ω" should be --0.1 μF--.

Signed and Sealed this

Sixteenth Day of April, 1996

Bruce Lehman

*Attest:*

BRUCE LEHMAN

*Attesting Officer*

*Commissioner of Patents and Trademarks*